US005167902A

United States Patent [19]

McCray et al.

[11] Patent Number: 5,167,902

[45] Date of Patent: Dec. 1, 1992

[54] DEVICE FOR PIERCING AN OBSTRUCTION IN A WELL-BLOCK OPENING OF A LADLE FOR TRANSPORTING MOLTEN STEEL

[75] Inventors: Walter A. McCray, Bearlake, Pa.; Michael D. Cope, Lansing, Ill.; Thomas J. Connors, East Chicago; Alex Csaszar, Valparaiso, Ind.

[73] Assignee: Tri-C Corporation, Schererville, Ind.

[21] Appl. No.: 733,731

[22] Filed: Jul. 19, 1991

[51] Int. Cl.[5] ..... B22D 41/22

[52] U.S. Cl. ..... 266/45; 266/271; 75/584; 222/590; 222/600

[58] Field of Search ..... 266/45, 271; 222/590, 222/600; 75/584

[56] References Cited

U.S. PATENT DOCUMENTS

| | | | |
|---|---|---|---|
| 3,262,692 | 7/1966 | Adams et al. . | |
| 4,202,533 | 5/1980 | Daussan et al. . | |
| 4,688,704 | 8/1987 | Detalle et al. | 222/590 |
| 4,746,037 | 5/1988 | Harasym | 222/591 |
| 4,795,066 | 1/1989 | Worrell | 222/590 |
| 4,877,161 | 10/1989 | Harasym | 222/591 |
| 4,913,314 | 4/1990 | Otsuka et al. | 222/590 |

FOREIGN PATENT DOCUMENTS

| | | | |
|---|---|---|---|
| 52755 | 3/1988 | Japan | 266/45 |
| 6044 | 1/1990 | Japan | 266/45 |

*Primary Examiner*—Melvyn J. Andrews

*Attorney, Agent, or Firm*—Milton S. Gerstein; Marvin N. Benn

[57] ABSTRACT

A dart-assembly for piercing open a blockage in the opening of a ladle for holding and transporting molten steel is mounted in the outlet bore of a slide-gate associated with the ladle opening. The assembly has an outer steel housing; mounted within the housing is a dart-member having an elongated rod, which rod has a lower threaded end for receiving a threaded nut. The upper end of the rod is provided with a dart-like head-portion which actually contacts and pierces through the blockage in the opening of the ladle when the dart-member is fired. A compression spring is telescopingly mounted about most of the length of the elongated rod of the dart-member, between the enlarged dart-like head-portion and the upper, flat-surface of a stop member. A restraining nut is screwed onto the lower, threaded end of the elongated rod of the dart-member, whereby the dart-member is prevented from being fired until the restraining nut is removed, which removal occurs only after the assembly has been emplaced within the outlet-bore of a slide-gate associated with the ladle. The open, upper top of the housing is closed off by a pivotal flap, which flap is pivoted open to allow for the firing of the dart-member only when the slide-gate has been moved to its completely open position where its bore is in complete alignment with outlet-bore of the well-block.

28 Claims, 6 Drawing Sheets

DEVICE FOR PIERCING AN OBSTRUCTION IN A WELL-BLOCK OPENING OF A LADLE FOR TRANSPORTING MOLTEN STEEL

BACKGROUND OF THE INVENTION

A conventional ladle is used to transport molten steel from a steel production furnace to a different location in order to dispense the molten steel into a mold or caster machine. This transportation process can take 15 minutes, or make take in excess of 4 hours, depending upon the distance that must be traveled, and, more importantly, the number of process stations (e.g. ladle met stations, degassers, etc. . . . ) along the way. A major concern is the heat-loss which occurs through the ladle's brick-lining and the well-block. The well-block is a large, refractory brick most commonly made of alumina with a hole through the center. A valve or slide-gate is placed at the bottom of the well-block. The operator opens the valve to allow the molten steel to flow from the ladle's cavity through the hole in the well-block, past the valve and into a mold or caster machine. The well-block is made of high alumina (A12 03) to withstand high temperatures of between 2750–3100 degrees Fahrenheit. However, high alumina materials also have high heat-transfer characteristics. High heat-transfer during the transportation of the ladle can result in the molten steel actually solidifying inside the well-block hole. Thus, when the slide-gate is opened, this solidified steel acts as a dam or block, and no steel may pass out of the ladle. A refractory sand material (zircon, carbon sand, and the like) is used to fill the hole in the well-block in order to prevent the steel from coming into contact with the well-block, which would cause "freezing-off" of the molten steel. Using refractory sand, upon the opening of the slide-gate, the sand will flow out, and followed by the molten steel.

Even with the use of refractory sand, steel mills have still had a considerable problem, with a large percentage percent of their ladles not opening free after the valve has been opened. This occurs because, although the majority of the refractory sand flows out, the steel/-sand interface forms a crust of mixed steel and sand in the shape of a dome. The dome acts as the dam, preventing the molten steel from flowing out. When this steel/sand blockage occurs, an operator must actually stand next to the bottom of the slide-valve, and push an oxygen-lance through the slide-valve and well-block, and into the solidified sand/steel interface. Oxygen is introduced at the blockage point, creating temperatures above 4000 degrees Fahrenheit. After the molten steel has begun to pour out through the valve, the operator must run away, in order to escape from the flowing molten steel. This conventional, prior-art technique is called "Lancing the Ladle Open."

A ladle-opening that requires the lancing technique creates a number of problems. Firstly, there is a safety problem for the operator who performs the lancing, as mentioned above. Secondly, there is a considerable cost associated with the technique of lancing, since multi-million dollar degasser facilities have had to have been built in order to get nitrogen out of the molten steel. Since air contains 72% nitrogen, every time this lancing technique is used to open a ladle, 10% to 20% of the steel is "D" graded, and sold at a far lesser value. Thirdly, the lancing technique for opening a ladle takes time. An operator has only a fixed period of time to open a ladle, or the interruption of molten-steel flow can shut down the casting machine. The cost to restart a casting machine is in excess of one-hundred-twenty thousand dollars.

SUMMARY OF THE INVENTION

It is the primary objective of the present invention to provide an assembly that is emplaced in the outlet bore of a slide-gate housing for propelling a dart-like member into the well-block opening, for piercing open a blockage of sand/molten steel interface, in order to allow for the molten steel in back of the blockage to flow out freely.

It is another objective of the present invention to provide such an assembly that does not require oxygen as in the prior-art oxygen-lancing techniques, to thereby save considerably on overhead costs, and in order to greatly increase the safety of the personnel working with the ladles.

It is still another objective of the present invention to provide such an assembly for breaking open the blockage in a ladle-opening that achieves the clearance of the ladle-opening in a relatively short period of time, whereby the chances of having to shut down a casting machine are minimized, with all of the cost-saving benefits accruing therefrom.

It is also an important objective of the invention is to open blockage in a ladle opening without disturbing the collection/shroud closed system.

According to the invention, the assembly for piercing open a blockage in the opening of a ladle for holding and transporting molten steel is mounted in the outlet-bore of a slide-gate associated with the ladle opening. The assembly has an outer, sealed, tubular, steel housing for protecting the operating structure housed therein from flowing sand. Mounted within the housing is a dart-member having an elongated rod, which rod has a lower threaded end for receiving a threaded nut. The upper end of the rod is provided with a dart-like head-portion which actually contacts and pierces through the blockage in the opening of the ladle when the dart-member is fired. Three, arcuately-spaced, centering spring-steel legs are provided in the lower portion of the housing, with each centering leg having a first end in abutting engagement with a lower stop member telescopingly-mounted about a lower portion of the dart-member's elongated rod, and a second end that projects outwardly of the housing through an opening formed in the housing. A compression spring is telescopingly-mounted about most of the length of the elongated rod of the dart-member, between the enlarged dart-like head-portion and the upper, flat-surface face of the stop member. A restraining nut is screwed onto the lower, threaded end of the elongated rod of the dart-member, whereby the dart-member is prevented from being fired until the restraining nut is removed, which removal occurs only after the assembly has been emplaced within the outlet-bore of a slide-gate associated with the ladle. The open, upper top of the housing is closed off by a pivotal flap, which flap is pivoted open to allow for the firing of the dart-member only when the slide-gate has been moved to its completely open position where its bore is in complete alignment with outlet-bore of the well-block, which firing of the dart-member is achieved by the compression spring, which forces open the pivotal, hinged flap when the bores of the well-block and slide-gate are aligned. In all other positions of the slide-gate, the pivotal flap is prevented from being pivoted to its open position. The restraining nut, when removed after emplacing the assembly in the bore of the slide-gate, allows for the compression spring to bias the three centering legs downwardly and outwardly, until their distal, exterior ends abut against the interior wall surface of the exit-bore of the slide-gate, whereupon which the three centering legs center and retain the assembly within the slide-gate bore until the dart-member has been fired to break open any blockage in the ladle-opening. The outer diameter of the outer assembly-housing is less than the inner diameter of the slide-gate's outlet bore not only to accommodate the centering legs, but also to allow for the refractory sand contained within the ladle-opening -below the blockage created by the sand/molten steel interface-to escape therepast, whereby unobstructed traveling of the dart-member to the blockage area is achieved when the dart-member has been fired. The dart-like head-portion may also be made hollow, in order to contain exothermic material, such as gun powder, to aid in the breaking open of the blockage, which material explodes upon the impact of the dart-like head-portion against the blockage.

In a modification, the three centering legs of spring-steel are fixedly connected at their inner ends to the outer surface of the main housing of the dart-assembly. The lower end of the compression spring abuts against a fixed stop member mounted about the dart-member's elongated rod.

BRIEF DESCRIPTION OF THE DRAWINGS

The invention will be more readily understood with reference to the accompanying drawing, wherein.

DETAILED DESCRIPTION OF THE INVENTION

Figure 1:
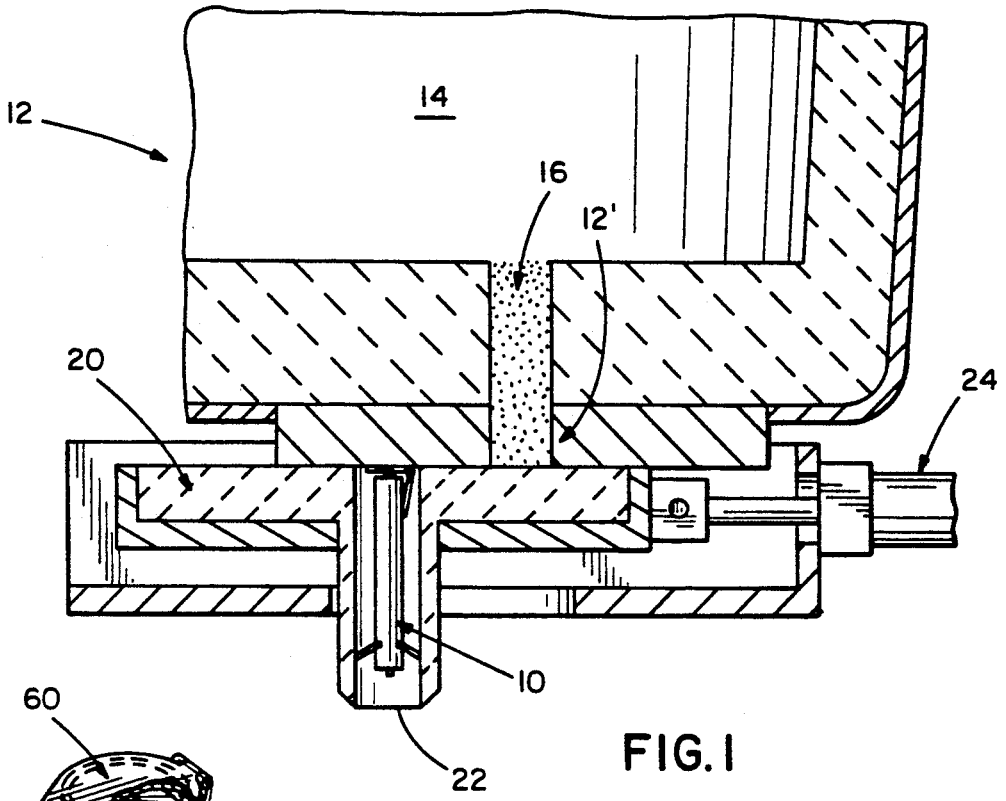
FIG. 1 is a cross-sectional view, in side elevation, showing the dart-assembly for piercing through a plugged opening of a well-block of a ladle for transporting molten steel according to the invention, in its cocked, ready-to-fire state, mounted below the well-block opening.
Figure 8:
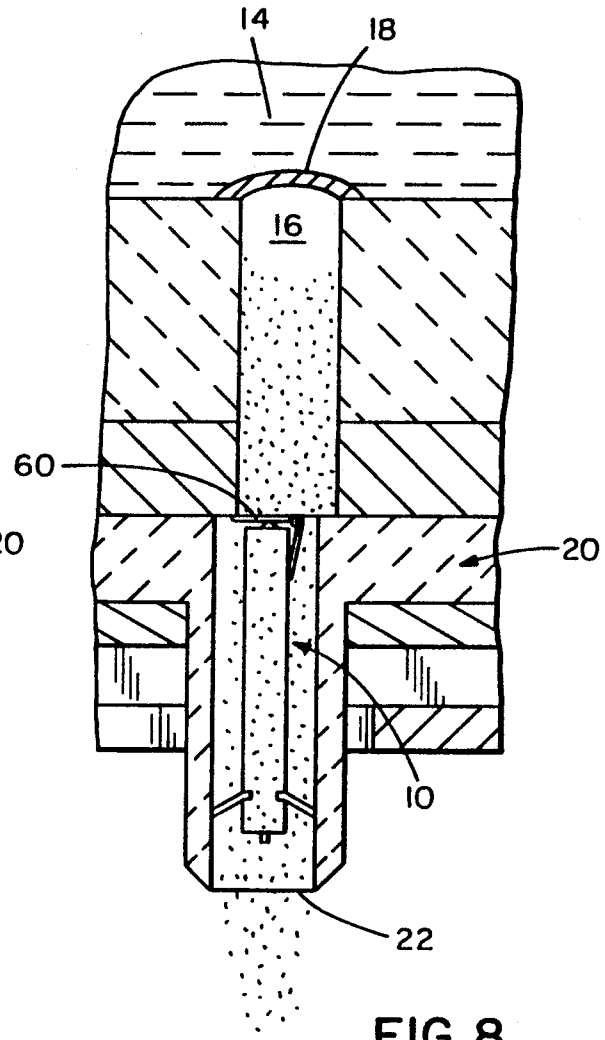
Figure 7:
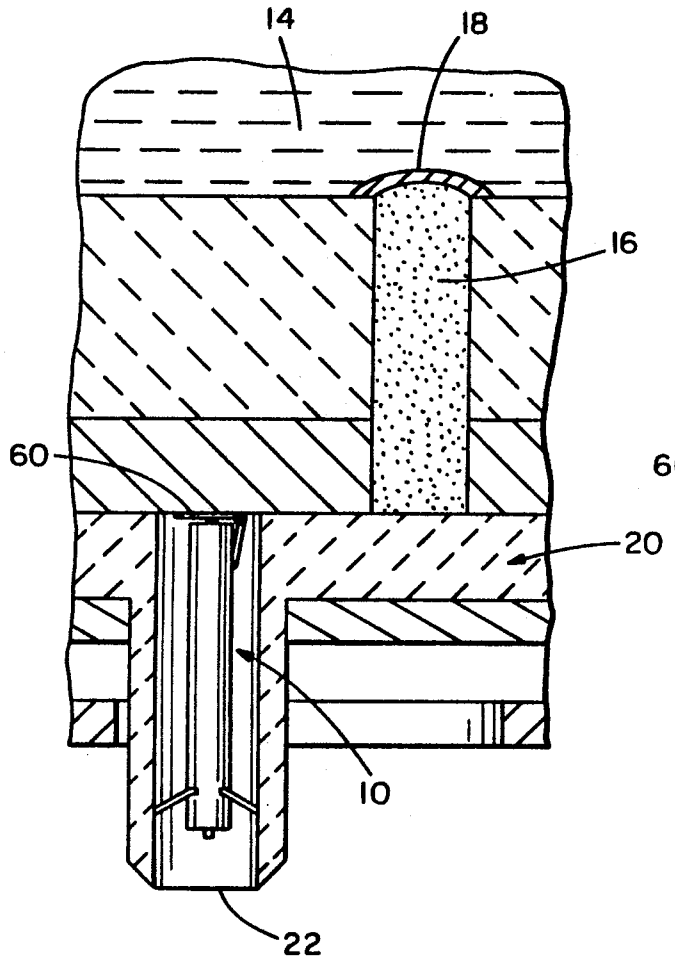

Referring now to the drawings in greater detail, the dart-assembly for piercing through a plugged opening of a well-block of a ladle for transporting molten steel according to the invention is indicated generally by reference numeral 10. With reference to FIG. 1, the dart-assembly 10 is used with a conventional ladle 12, which ladle 12 has a hollow interior volume 14 for storing the molten steel, and a well-block 12' having an exit-opening, or bore, 16 through which the molten steel flows out of the ladle. The exit-bore 16 is typically filled with refractory sand in order to prevent heat loss, in order to prevent solidification of the molten steel during transportation of the ladle 12. As explained above, the interface between the refractory sand and the molten steel tends to form a dome-shaped blockage 18, as seen in FIGS. 7 and 8, which prevents the molten steel therebehind from flowing out through the exit-bore 16. Associated with the well-block 12' is a slide-gate, or valve, 20 having an exit-opening, or bore, 22. The slide-gate 20 is slid to the right when viewing FIG. 1 in order to align the exit-bore 22 thereof with the exit-bore 16 of the well-block, in order to permit the exit-flow of the molten steel, when the ladle 12 has reached its destination point. During the transportation of the ladle 12, however, the slide-gate 20 is positioned as shown in FIGS. 1 and 7, so that the exit-bore 22 is moved to the left of the exit-bore 16 and completely out of alignment therewith, whereby the flow of molten steel and refractory sand in the exit-bore 16 is prevented. A piston-cylinder mechanism 24 mounted to the ladle frame reciprocates the slide-gate 20 to the desired position thereof, in the conventional manner. The dart-assembly 10 of the invention is positioned with the exit-bore 22 of the slide-gate 20, as explained below in greater detail, whereby, when the exit-bore 22 is in complete coaxial alignment with the exit-bore 16 of the well-block 12' of the ladle, a dart is fired from the dart-assembly 10 to contact and penetrate through the dome-shaped blockage 18, in order to free the molten steel in the ladle, to flow therepast and out through the aligned bores 16 and 22.

Figure 2:
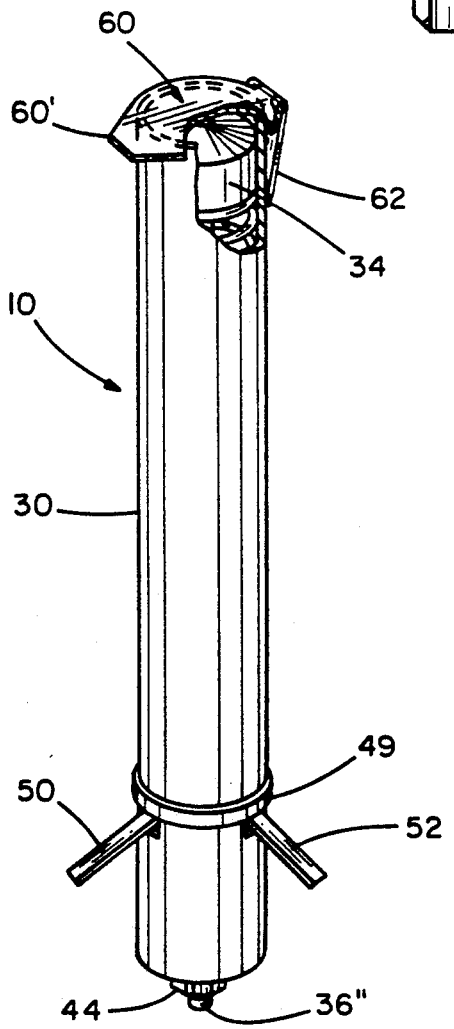
FIG. 2 is an isometric view of the dart-assembly for piercing through a plugged opening of a well-block of a ladle for transporting molten steel of FIG. 1.
Figure 3:
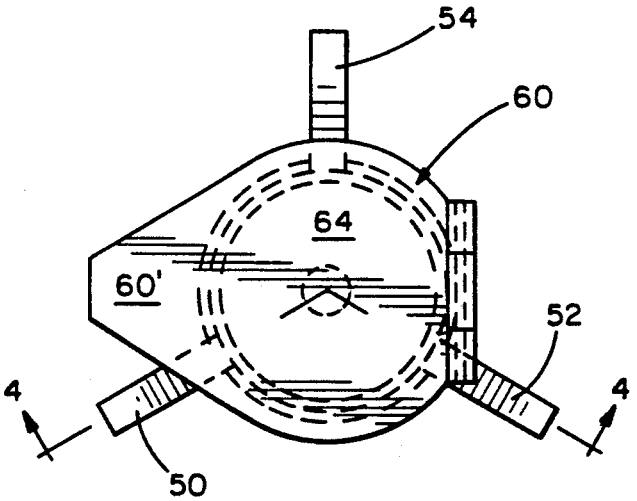
FIG. 3 is a top view of the dart-assembly for piercing through a plugged opening of a well-block of a ladle for transporting molten steel of FIG. 2.
Figure 4:
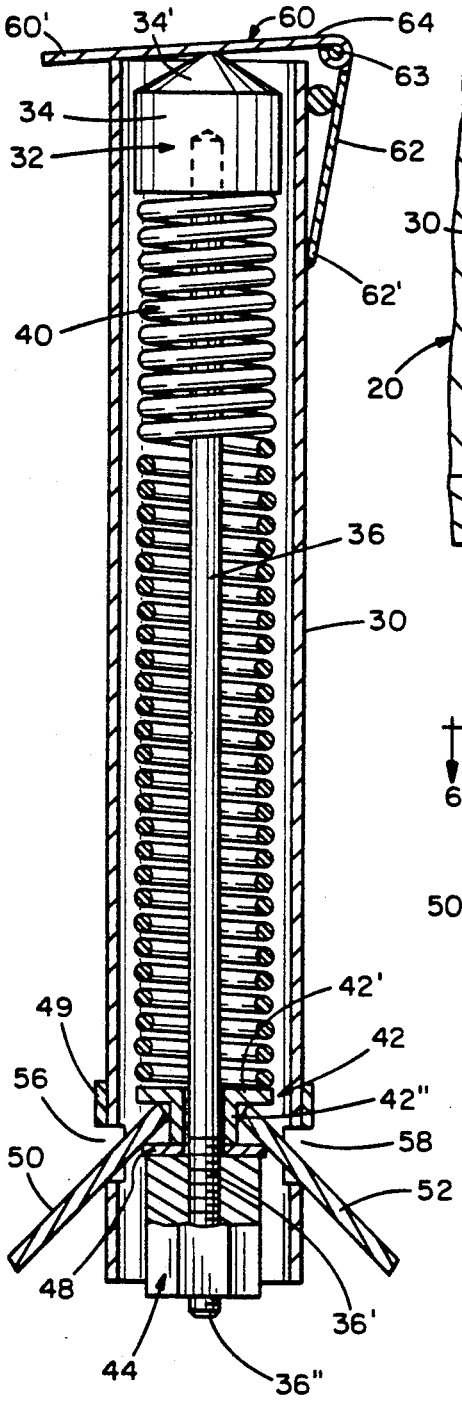
FIG. 4 is a cross-sectional view taken along line 4—4 of FIG. 2.
Figure 5:
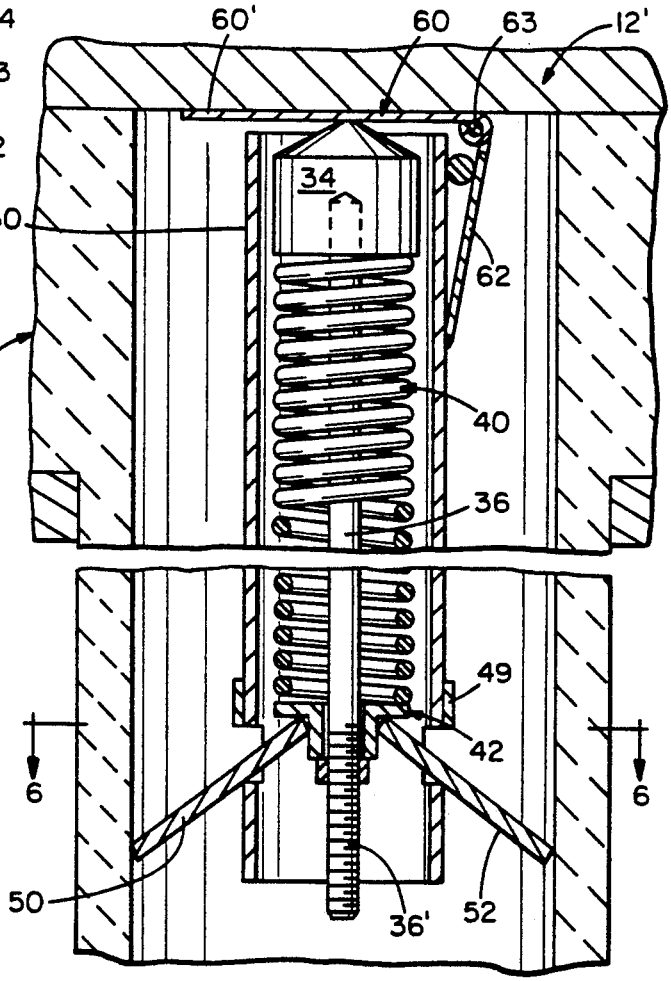
FIG. 5 is a detailed, cross-sectional view of the dart-assembly for piercing through a plugged opening of a well-block of a ladle for transporting molten steel mounted within the exit-bore of the slide-gate housing.
Figure 6:
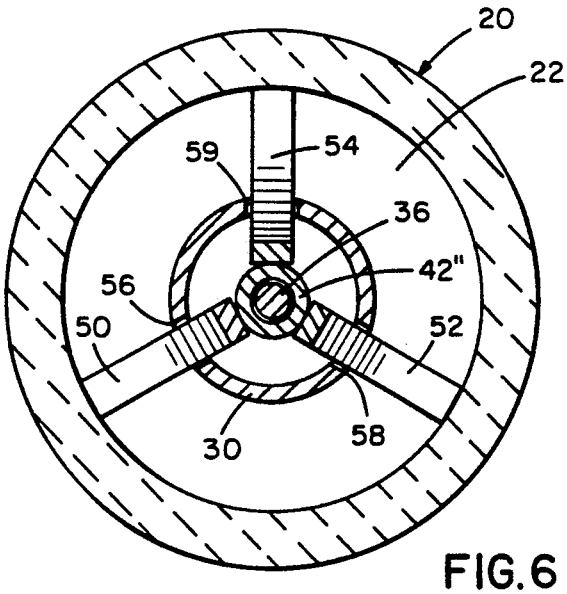
FIG. 6 is a cross-sectional view taken along line 6—6 of FIG. 5.

Referring to FIGS. 2-6, the dart-assembly 10 of the invention is shown in detail. The dart-assembly 10 has an outer, cylindrically-shaped steel housing 30, for mounting in the interior volume thereof the operating parts of the dart-assembly 10. The operating parts mounted within the housing 30 are best seen in FIGS. 4-6. A dart-member 32, made of steel, aluminum, or alloy, has an enlarged dart-like head-portion 34 positioned adjacent the upper opening of the main housing 30. Preferably, for maximum piercing effect, the head-portion 34 has a blunt tip 34', although a sharp tip may also be used. Extending from the center of the dart-like head-portion 34 is an elongated shaft, or rod, 36, the upper end of which is fixedly connected to the dart-like head-portion 34, and the lower end 36' of which projects downwardly through the interior of the main housing. The lower end 36' of the shaft 36 is threaded, and has a portion 36" that projects slightly from the lower opening of the main housing. Telescopingly mounted about the elongated shaft 36 is a firing compression spring 40 providing 250 pounds of force and having an upper end in abutment against the lower surface face of the dart-like heat-portion 34. The compression spring 40 has a lower end that abuts against an annular stop member 42 that is freely, slidingly and telescopingly-mounted about a portion of the elongated shaft 36 adjacent the threaded lower end portion 36' of the shaft 36. The stop member, or collar, 42 has an upper, annular ring-member, or washer-like member, 42' that defines an upper surface face against which the lower end of the compression spring 40 abuts. The collar 42 also has a smaller-diameter tubular member 42" which is used in conjunction with centering legs, described below in greater detail. A restraining nut 44 is threadingly mounted onto the threaded lower end portion 36' of the elongated shaft 36, with a washer 48, which restraining nut is rotated the requisite amount so as to place the compression spring 40 in proper compression, so that the stop member 42 thereof is moved upwardly along the shaft 36 thereby. As explained below in detail, the restraining nut is used for mounting the assembly 10 in the exit-bore 22 of a slide-gate 20 by unscrewing it from the lower end portion 36' of the shaft 36 after the assembly 10 has been inserted in the exit-bore and placed in position therein, with the restraining nut being completely removed, so as to allow for the centering legs of the assembly 10 to be biassed outwardly by the spring 40, to mount and center the assembly in the exit-bore. The restraining nut 44 also serves as a safety measure by preventing reverse firing. The nut 44 with washer also serves to forcibly push up on the portions of the centering legs in contact therewith, so as to prevent the legs from falling out of the slots when the assembly is not mounted in the well-bore 22, whereby the portions of the legs between the nut-washer assembly 44 and the upper surface of a respective slot or opening 56, 58, 59—described below—are tightly gripped therebetween until the nut assembly is loosened, which occurs during installation in the bore 22. An annular stiffening ring 49 is welded to the circumferential portion of the outer wall of the housing 30 directly above the upper surfaces of the slots, in order to provide additional structural support thereto for accommodating the forces created by the tightened nut assembly 44 and the stresses created by the contact of the leg portions against the upper surfaces of the slots.

Three arcuately-spaced centering legs 50, 52, 54 made of spring-steel are used for resiliently and removably mounting the dart-assembly 10 in the exit-bore 22. The three legs 50, 52, 54 are spaced preferably 120 degrees apart. Each centering leg has an upper end that abuts against the right-angle surface formed between the annular ring-member 42' and the smaller-diameter tubular member 42" of the collar unit 42. The three centering legs also project outwardly through the main housing 30 via the above-mentioned three arcuate slots, or openings, 56, 58, 59 formed in the main housing 30, which slots are also spaced 120 degrees apart. The centering legs project through the respective arcuate openings with the distal, exterior ends thereof capable of contacting, centering and holding the assembly 10 to the interior surface of the main housing 30 after the restraining nut 44 has been removed, such removal of the restraining nut allowing the compression spring 40 to push the collar unit 42 downwardly along the shaft 36, which, in turn, causes the upper, interior ends of the centering legs to be moved downwardly therewith. This downward movement of the upper end of the centering legs causes the centering legs 50, 52, 54 to pivot about a fulcrum defined by the surface-contact of the respective centering leg with a lower surface portion of the respective arcuate slot, and also causes outward, sliding movement of the centering legs at the same time. This pivotal movement of the centering legs causes their distal, exterior ends to be moved upwardly and, therefore, outwardly into contact with the portions of the interior wall surface of the main housing 30, by which the assembly 10 is centered within the exit bore 22, and resiliently, removably and stationarily mounted therein, until the dart-member 32 is fired.

Mounted on the top of the main housing 30 is a pivotally-mounted, hinged flap-member 60 used for timing the firing of the dart-member from the exit-bore. This flap member 60 may be made of steel, plastic, or ceramics, and is a relatively wider member as seen in FIGS. 2 and 3, in order to seal the interior of the main housing, so that flowing refractory sand is prevented from entering into the interior of the main housing, as explained below. The flap-member has a width greater than the diameter of the main housing 30 to provide such a seal, which width, however, is less than the width of the diameter of exit-bore 22 or 16. Without the flap-member, or door, 60, the dart-member would be fired before there is complete coaxial alignment between the exit-bore of the slide-gate and the exit-bore of the well-block. As explained below when discussing FIGS. 7-9, it is preferred to fire the dart-member only after complete coaxial alignment of the exit-bores has been achieved, in order to allow for the escape of refractory sand from the exit-bore 16 of the well-block, in order to make accessible the dome-shaped blockage 18 to the dart-member. Toward this end, the main housing 30 has a diameter less than the diameter of the exit-bore 22 in which it is mounted, in order to define an annular, free volume between the main housing 30 and the interior wall surface of the exit bore 22 through which the refractory sand may escape before complete coaxial alignment between the exit-bores 16 and 22 occurs. As can be seen in FIG. 4, the pivotal flap-member 60 has an overhanging end portion 60' which abuts against the oppositely-facing, juxtapositioned, lower surface of the well-block to prevent the door from being pivoted open by the compression spring. The dimensions are such that the overhanging end portion 60' only clears the lower surface of the well-block, in front of the opening of the exit-bore 16 of the well-block, when the two bores 16 and 22 are in complete, coaxial alignment. This overlapping end portion 60', therefore, preferably has a length of one-half the diameter of the exit-bores, which exit bores are approximately equal in, so that, just when the remote end of the overhanging portion 60' clears the underside of the well-block and is pivoted open by the force of the spring, the two exit-bores are in complete, coaxial alignment. Thus, the hinged door 60 provides a timing to the released firing of the dart-member, so that such firing only occurs when coaxial, linear alignment of the exit bores occurs. In the preferred embodiment shown, the hinged door or flap is made of steel, and has a side-leg portion 62 welded at its lower end 62' to an outer, upper portion of the main housing. The side-leg portion 62 has a pivot pin, or hinge, 63 at its upper end for rotatably mounting the flap-proper 64 of the door 60, as can best be seen in FIGS. 2 and 3. The flap-proper 63 is freely pivotal about the pivot pin 63.

When the restraining nut 44 is threaded on the lower end portion 36' of the dart-assembly's elongated shaft 36, the compression spring 40 is compressed and held in place. After the assembly 10 has been mounted inside the exit-bore 22 of a slide-gate 20, and the restraining nut 44 is unthreaded and removed from the shaft 36, the upper end of the compression spring is held in place and prevented from upward movement by virtue of the fact that the hinged flap-member 60 is prevented from being pivoted open by the contact thereof against the lower surface of the well-block 12', as shown in FIGS. 1 and 7. Thus, upon the removal of the restraining nut 44, only the lower end of the compression spring 40 is allowed relative movement, which, thus, causes the pivotal and sliding movement of the three centering legs 50, 52, 54, via the slidable collar unit 42, as described above. Only when the exit-bore 22 of the slide-gate 20 is complete, coaxial alignment with the exit-bore 16 of the well-block 12' of the ladle is the hinged flap-member 60 allowed free movement, whereupon the dart-member 32 is fired outwardly of the exit-bore, and forces the door 60 open, with the reaction force being provided by the three centering legs and their forced abutment against the interior wall surface of the main housing 30.

Figure 9:
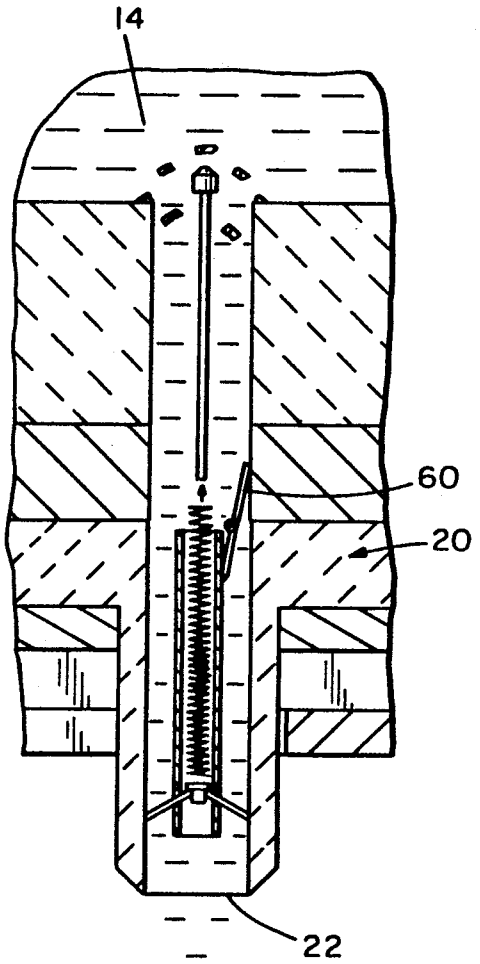
FIGS. 7-9 are cross-sectional views of the dart-assembly for piercing through a plugged opening of a well-block of a ladle for transporting molten steel in relationship to the well-block opening showing the stages of the dart-assembly from its cocked, ready-to-fire state to its actuated, fired state for piercing through the blockage in the well-block opening.

FIGS. 7–9 show the stages from the prepared, ready-to-fire state of the dart-assembly 10 and the final, fired-state thereof. In FIG. 7, the dart-assembly 10 is in its ready-to-fire state, with the slide-gate 20 closed, where the exit-bore 22 of the slide-gate is in complete misalignment with the exit-bore 16 of the well-block of the ladle. In FIG. 8, the slide-valve has been slid partially to the right, for beginning the pouring out of the molten steel. In this stage, the exit-bore 22 of the slide-gate is in partial alignment with the exit-bore 16 of the well-block. This partial-alignment state is important, since the dart-assembly 10 is prevented from being fired by the contact of the overlapping portion 60' of the door 60 with the underside of the well-block. However, the refractory sand material contained in the exit-bore 16 of the well-block is allowed to exit and escape via this partial alignment, by virtue of the fact that the dart-assembly's housing 30 is smaller than the interior diameter of the exit-bore 22 of the slide-gate, whereby the annular region thereabout allows the sand to flow therepast. This escape of the refractory sand in the exit-bore 16 of the well-block allows unobstructed access to the dome-shaped blockage 18 by the dart-member 32, when it is fired, when the two exit-bores are in complete coaxial alignment, in the state as shown in FIG. 9. After the dome-shaped blockage 18 has been pierced through, and the molten steel is free to flow out, owing to the extremely high temperature of the molten steel, the entire dart-assembly is melted in a matter of a few seconds, with the melted material simply being swept away along with the molten steel. Since the dart-assembly's mass is miniscule compared with the amount of molten steel in the ladle, no contamination of the molten steel occurs.

It is, of course, possible to provide the projectile force by means other than the compression spring. For example, compressed rubber may be used, or compressed gas or powder-activation may also be employed to fire the dart-member 32. In addition, the dart head-portion 34 may also be provided with exothermic material, such as magnesium carbide, gun powder, solid fuel, and the like, which will provide a controlled explosion upon the impact of the dart head-portion 34 with the blockage 18, in order to better ensure the break-up of the blockage. Furthermore, the timed-delay firing of the dart-member in order to ensure that the refractory sand has first exited and that the two exit-bores are in alignment could be achieved by other means, as well. For example, an electronically-triggered device, or a heat-activated firing mechanism in conjunction with a booster or powder activated dart, may be employed.

Figure 10:
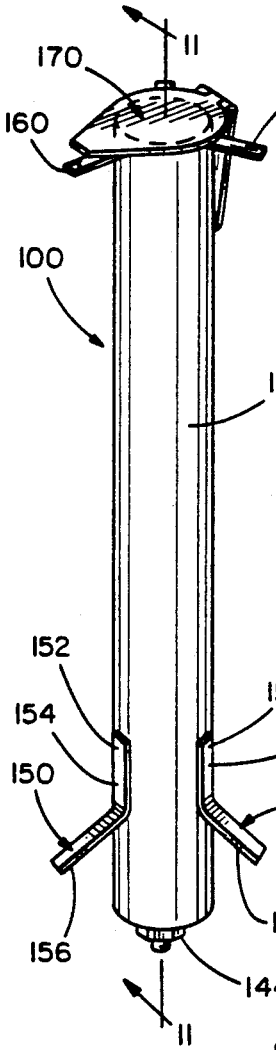
FIG. 10 is an isometric view of a modification of the dart-assembly according to the invention.
Figure 11:
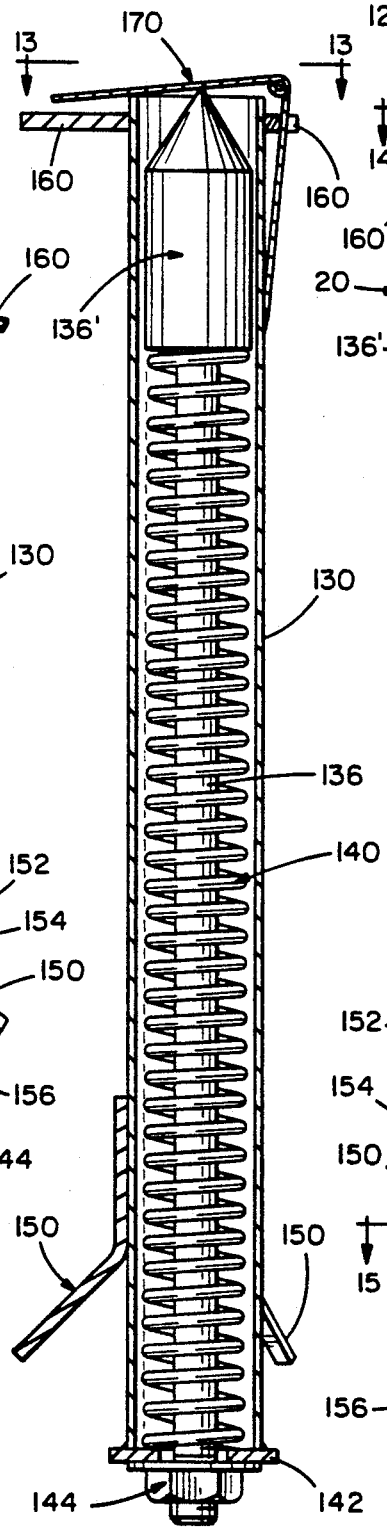
FIG. 11 is a side view, in cross section, taken along line 11—11 of FIG. 10.
Figure 12:
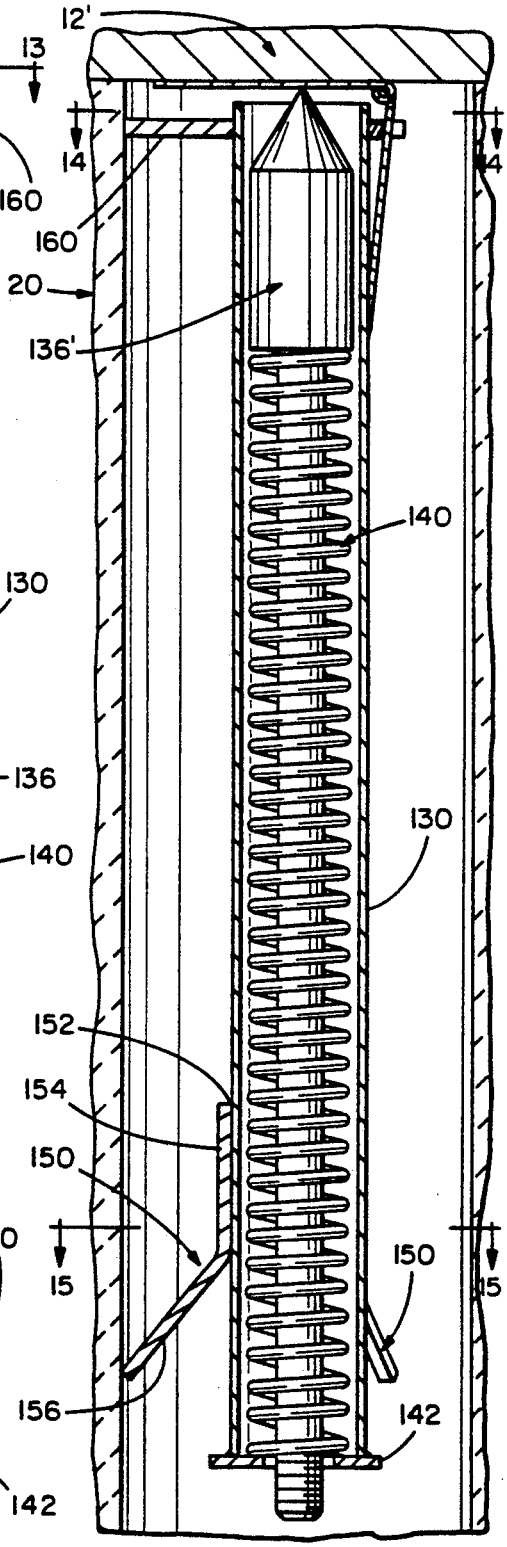
FIG. 12 is a view similar to FIG. 11 showing the dart-member in its initial stage of firing.
Figure 13:
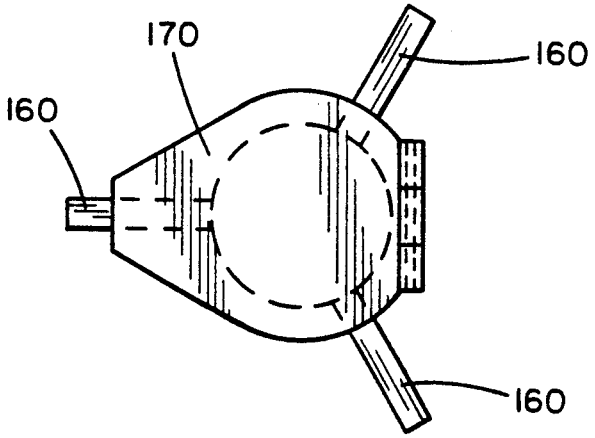
FIG. 13 is a top plan view taken along line 13—13 of FIG. 11.
Figure 14:
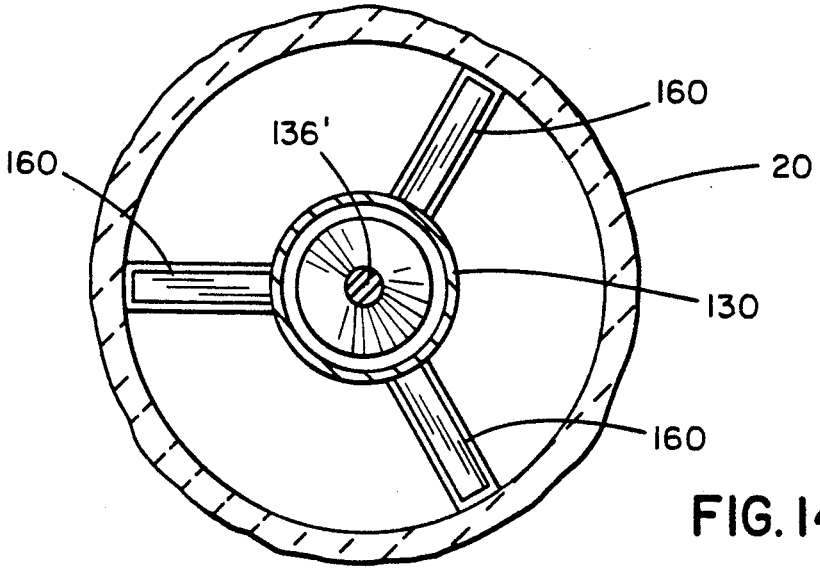
FIG. 14 is a cross-sectional view taken along line 14—14 of FIG. 12.
Figure 15:
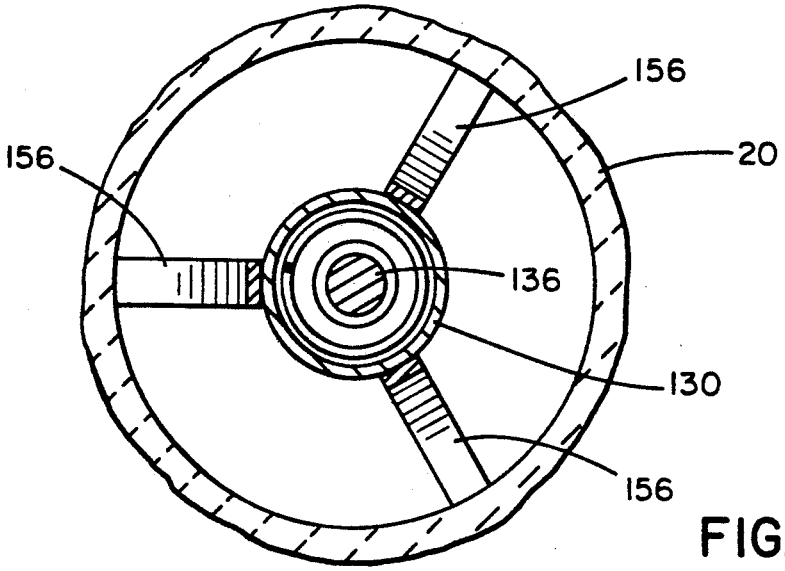
FIG. 15 is a cross-sectional view taken along line 15—15 of FIG. 12.

FIGS. 10–15 show a second embodiment of the dart-assembly of the invention, and is indicated generally by reference numeral 100. The dart-assembly 100 is similar to the dart-assembly 10, except for the following differences. Three centering legs 150 are provided, with each leg having a first inner end 152 fixedly attached to an outer surface wall portion of the main housing 130. Each centering leg has a downwardly-extending straight portion 154 that substantially abuts against, and is parallel to, the juxtapositioned surface portion of the main housing, which straight portion turns into a bent portion 156 extending at an acute angle with respect to the straight portion. Each leg 150 is made of spring steel, so that, when the dart-assembly 100 is inserted upwardly into an exit-bore of a slide-gate, the spring-steel legs 150 accommodate such insertion until the upper part of the assembly—that is, the hinged door 170, or flap-member—abuts against the lower surface of the well-block juxtapositioned thereat. Upon reaching this position, the legs 150 automatically and resiliently mount and center the assembly 100 in the exit-bore. In this embodiment, there is no slidable collar unit 42, but rather there is provided a fixedly secured stop-member 142 mounted or welded to the bottom, or lower, opening of the main housing 130, which stop-member has a central hole through which extends the lower end portion of the rod 136. In this embodiment, a compression spring 140 has a second, lower end extending all the way into close proximity to the lower, or bottom, open mouth of the main housing for abutting contact against the interior-facing surface of the stop-member 142. A restraining nut assembly with washer 144 similar to the assembly 44 is provided for preventing the firing of the dart-member prior to the mounting thereof in an exit-bore of a slide-gate. The dart-assembly 100 is also provided with three upper centering legs 160, which are spaced 120 degrees apart, as seen in FIGS. 10 and 13, with each of these centering legs being a substantially straight or linear member projecting from an upper exterior surface of the main housing 130. The three legs 160 lie substantially in the same horizontal plane, and are used for initially centering the dart-assembly 100 in the bore 22 of the slide-gate, as the dart-assembly is inserted upwardly into the bore 22. The centering legs 160 also serve to stabilize the dart-assembly when fully inserted with the lower centering legs 160 in position, so as to ensure a more precise aiming, control and stabilized flight of the fired dart-member 136'. The hinged door 170 is substantially identical to that of the embodiment of FIGS. 1–6.

The first embodiment of FIGS. 1–6 is preferably used for slide-gates having an exit-bore of less than 3.5 inches in diameter, or where the slide-gate is reused, while the embodiment of FIGS. 10–15 is preferably used in slide-gates having an exit-bore of 3.5 inches in diameter or greater.

Figure 16:
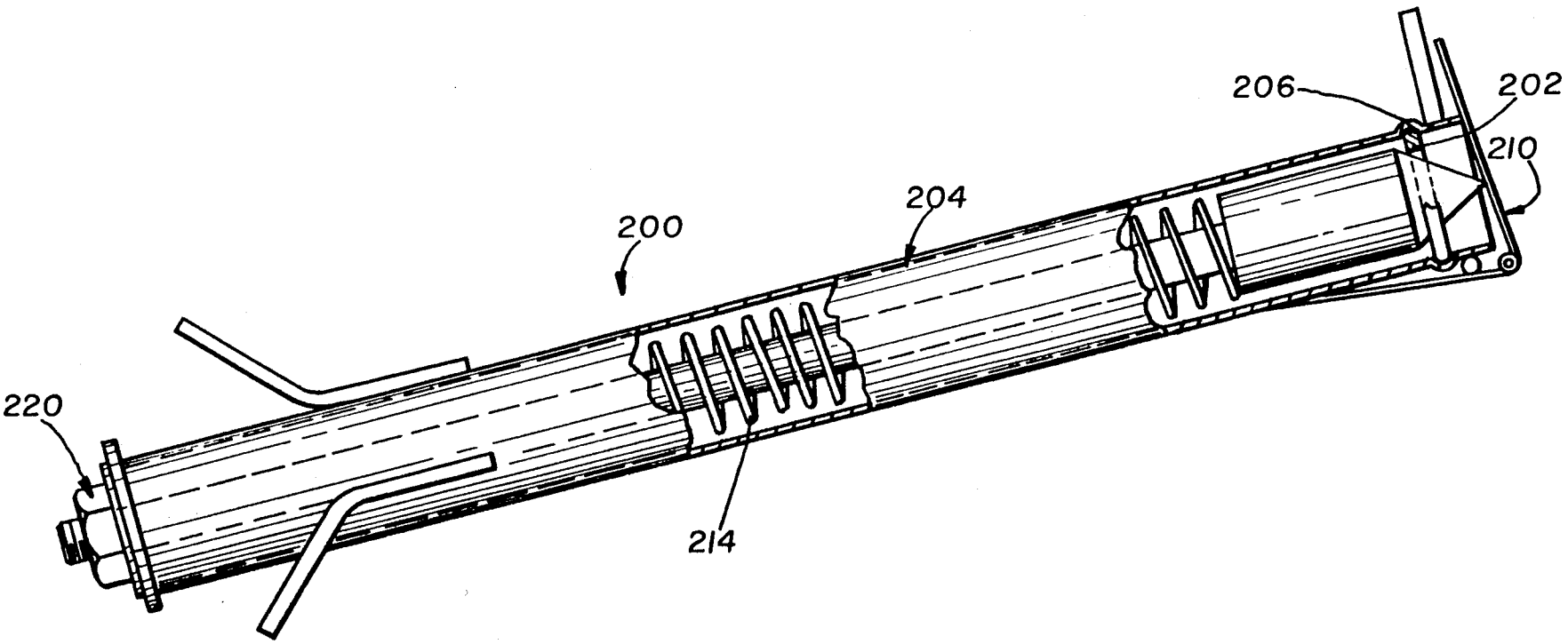
FIG. 16 is a plan view of a modification of the invention which incorporates a safety feature that prevents the dart-member from being fired until mounted inside an opening of a slide-gate, so that accidents to those handling the invention are effectively prevented.

FIG. 16 shows another modification in which there is provided a safety feature that prevents the accidental firing of the dart member before it is positioned inside the slide-gate opening. The device 200 shown in FIG. 16 is almost identical to either of the devices 10 or 100. Although the device 200 is shown as being similar to the device 100, it may be similar to the device 10. The device 200 differs from the devices 10 and 100 in that there is provided a safety feature which is embodied by a lock-washer element 202. The washer element 202 is positioned in the upper part of the main housing 204, and is held in place in an annular groove 206 formed in the inner circumference of the main housing, as clearly seen in FIG. 16. The groove 206 is positioned a predetermined distance below the hinged cover or door 210. The lock-washer element 202 is made of an alloy or a plastic which has the strength to hold the dart member back from the firing force provided by the compression firing spring 214. This material from which it made has a low melting point, and may be, for example, bismuth with a melting point of 518 F., tin with a melting point of 512 F., lead with a melting point of 620 F., antimony with a melting point of 790 F., or a combination of metal alloy and/or suitable plastics. The lock-washer element is inserted into the upper opening of the main housing 204 of the dart-member and pressed into the annular groove after the dart-tip has been lowered to a level below the annular groove and held thereat via the locking nut 220 at the threaded bottom of the elongated rod of the dart-member. When set in place, this lock-washer element 202 will prevent the firing of the dart-member even after the locking nut 220 has been removed. The dart-member can only be fired after the device 200 has been mounted within a slide-gate bore, and after the slide-gate bore has been aligned with the well-block opening of the ladle. This alignment of the two bores immediately heats up the air space in the slide-gate bore, which causes the lock-washer element 202 to melt in a matter of a couple of seconds, which thereby allows the dart-member to be fired upwardly in the manner described above with regards to the devices 10 and 100. This safety feature provided by the lock-nut washer prevents accidental firings of the dart-member during all stages of handling, including manufacture and shipping.

In addition to its action as a safety feature, the lock-washer element 202 serves as a time-delay mechanism, since it takes time for the washer element 202 to melt or vaporize. The rapidity by which the washer element 202 melts is controllable by choosing a particular type of material. For a longer time delay, material having a higher melting point is used, while for shorter time delays, a lower-melting point material is used. Thus, it is within the breadth and scope of the invention to eliminate the hinged cover or door 170 altogether for timing delays, and use just the lock-washer element 202; or, both may be used in conjunction with each other in the manner shown in FIG. 16.

A variation of the safety ring or washer 202 is to do away with it entirely and simply weld the pivotal flap closed to the upper rim of the steel housing. The weld, made preferably of silver/solder, would melt upon the alignment of the two bores, which alignment heats the air space, in the manner described above.

While specific embodiments of the invention have been shown and described, it is to be understood that numerous changes and modifications may be made therein without departing from the scope, spirit and intent of the invention as set forth in the appended claims.

What we claim is:

1. In a ladle for holding and transporting molten material, said ladle comprising a well-block having an exit-bore through which the molten material exits, said exit-bore having refractory sand therein forming an interface with the molten material contained in said ladle, which interface defines a blockage preventing the flow of molten material therepast, and a slide-gate for controlling the removal of the molten material, said slide-gate having a main frame, means for sliding the main frame relative to said well-block, said slide-gate having an exit-bore that is capable of alignment with said exit-bore of said well-block when said means for sliding align said exit-bores, wherein the improvement comprises:

piercing means mounted in said exit-bore of said slide-gate for piercingly breaking open the blockage at said interface between said refractory sand and said molten material;

said piercing means comprising a dart-like assembly, said assembly comprising a main outer housing having a hollow interior, a dart-member having an enlarged dart head-portion and an elongated shaft extending from said dart head-portion, firing means for propelling said dart-member from said main housing when said exit-bores are in alignment for piercing and breaking said blockage, and means for releasably mounting said main outer housing in said exit-bore of said slide-gate.

2. The improvement according to claim 1, wherein said firing means comprises a compression spring telescopingly mounted about said elongated shaft of said dart-member, said elongated shaft having a stop-member associated therewith positioned along a lower portion of said elongated shaft, said compression spring having a first upper end in abutting engagement with said enlarged head-portion and a second lower end in abutting engagement with said stop-member.

3. The improvement according to claim 2, wherein said means for releasably mounting comprises a plurality of arcuately-spaced centering legs, said stop-member comprising a telescopingly-mounted, slidable collar member, said main housing having a plurality of arcuately-spaced openings, each said centering leg having a first end in abutting engagement with a portion of said collar member, and a second end projecting through a respective said opening of said main housing for engagement with an interior wall portion of said exit-bore of said slide-gate; said compression spring biassing said collar member downwardly on said elongated shaft for thereby urging said centering legs into engagement with said interior wall portions of said exit-bore of said slide-gate.

4. The improvement according to claim 1, wherein said means for releasably mounting comprises three said centering legs, each said centering leg having at least portion thereof extending downwardly at an acute angle with respect to the longitudinal center line of said main housing.

5. The improvement according to claim 3, wherein said elongated shaft member comprises a lower threaded end-portion, said dart-assembly further comprising a restraining nut for threaded engagement with said threaded end-portion of said elongated shaft, said restraining nut compressing and restraining said spring until said dart-assembly is positioned in said exit-bore of said slide-gate, whereby, upon removal of said nut after said dart-assembly has been positioned in said exit-bore of said slide-gate, said lower, second end of said spring is free to bias and slide said collar member downwardly along said elongated shaft, to thereby move said legs outwardly until said second ends of said centering legs are in abutting engagement with said interior wall portions of said exit-bore of said slide-gate.

6. The improvement according to claim 1, wherein said elongated shaft member comprises a lower threaded end-portion, said dart-assembly further comprising a restraining nut for threaded engagement with said threaded end-portion of said elongated shaft, said restraining nut restraining said spring from firing the dart-member until said dart-assembly is positioned in said exit-bore of said slide-gate.

7. The improvement according to claim 5, wherein said collar member comprises an enlarged section and a tubular section extending downwardly from said enlarged section to define an annular right-angle surface about said collar member, each said first end of said centering legs being in abutting engagement with a portion of said annular right-angle surface.

8. The improvement according to claim 1, further comprising a delay means for preventing the firing of said piercing means until said exit-bores are in alignment

9. The improvement according to claim 1, wherein said main housing comprises a delay means for preventing the firing of said dart-member until said exit-bores are in complete coaxial alignment; said delay means comprising a flap-member hingingly mounted at the upper end portion of said main housing for closing off the open upper end of said main housing until said exit-bores are in complete coaxial alignment.

10. The improvement according to claim 9, wherein said flap-member has a length greater than the diameter of said main housing to define an overhanging end portion that projects beyond the outer boundary of said main housing, whereby said overhanging end portion retains said flap-member in its pivoted-down, closed state for closing off said open upper mouth of said main housing to prevent the firing of said dart-member by contact of the upper surface of said overhanging end portion with the underside of said well-block until said exit-bores are in complete, coaxial alignment, at which point, said overhanging end portion is free to pivot open to allow for the firing of said dart-member; said flap-member also having a width greater than the opening of said main housing, in order to seal the interior of said main housing from flowing refractory sand.

11. A dart-assembly for piercing through and breaking open a blockage in an exit-bore of a well-block of a ladle for holding and transporting molten material, said dart assembly being positionable in an exit-bore of a slide-gate associated with the exit-bore of the well-block, comprising:

a main outer housing having a hollow interior;

a dart-member having an enlarged dart head-portion and an elongated shaft extending from said dart head-portion;

firing means operatively coupled to said dart-member for propelling said dart-member from said main housing for piercing and breaking said blockage; and means for releasably mounting said main housing in an exit-bore of a slide-gate.

12. The improvement according to claim 11, wherein said firing means comprises a compression spring telescopingly mounted about said elongated shaft of said dart-member, said elongated shaft having a stop-member positioned along a lower portion thereof, said compression spring having a first upper end in abutting engagement with said enlarged head-portion and a second lower end in abutting engagement with said stop-member.

13. The improvement according to claim 12, wherein said means for releasably mounting comprises a plurality of arcuately-spaced centering legs, said stop-member comprising a telescopingly-mounted, slidable collar member, said main housing having a plurality of arcuately-spaced openings, each said centering leg having a first end in abutting engagement with a portion of said collar member, and a second end projecting through a respective said opening of said main housing for engagement with an interior wall portion of an exit-bore of a slide-gate; said compression spring biassing said collar member downwardly on said elongated shaft for thereby urging said centering legs outwardly.

14. The improvement according to claim 12, wherein said means for releasably mounting comprises a first set of three lower said centering legs, each said first centering leg having at least a portion thereof extending downwardly at an acute angle with respect to the longitudinal center line of said main housing, and a second set of three upper centering legs, each said second centering leg being a substantially straight leg.

15. The improvement according to claim 13, wherein said elongated shaft member comprises a lower threaded end-portion, said dart-assembly further comprising a restraining nut for threaded engagement with said threaded end-portion of said elongated shaft, said restraining nut compressing and restraining said spring until said dart-assembly is positioned in an exit-bore of a slide-gate, whereby, upon removal of said nut after said dart-assembly has been positioned in an exit-bore of a slide-gate, said lower, second end of said spring is free to bias and slide said collar member downwardly along said elongated shaft, to thereby move said means centering legs outwardly.

16. The improvement according to claim 11, wherein said elongated shaft member comprises a lower threaded end-portion, said dart-assembly further comprising a restraining nut for threaded engagement with said threaded end-portion of said elongated shaft, said restraining nut restraining said spring until said dart-assembly is positioned in an exit-bore of a slide-gate.

17. The improvement according to claim 13, wherein said collar member comprises an enlarged section and a tubular section extending downwardly from said enlarged section to define an annular right-angle surface about said collar member, each said first end of said centering legs being in abutting engagement with a portion of said annular right-angle surface.

18. The improvement according to claim 11, further comprising a delay means for preventing the firing of said piercing means until the exit-bores of a slide-gate and well-block are in complete coaxial, linear alignment.

19. The improvement according to claim 11, wherein said main housing comprises a delay means for preventing the firing of said dart-member until the exit-bores of a slide-gate and well-block are in complete coaxial alignment; said delay means comprising a flap-member hingingly mounted to the upper end portion of said main housing for closing off the open upper end of said main housing until the exit-bores are in complete coaxial alignment.

20. The improvement according to claim 19, wherein said flap-member has a length greater than the diameter of said main housing to define an overhanging end portion that projects beyond the outer boundary of said main housing, said flap-member having a width greater than the diameter of said main housing and less than the diameter of said exit-bores, whereby said overhanging end portion retains said flap-member in its pivoted-down, closed state for closing off said open upper mouth of said main housing to prevent the firing of said dart-member by contact of the upper surface of said overhanging end portion with the underside of a well-block until the exit-bores are in complete, coaxial, linear alignment, at which point, said overhanging end portion is free to pivot open to allow for the firing of said dart-member.

21. The improvement according to claim 11, further comprising safety means for preventing the accidental firing of said dart-member.

22. The improvement according to claim 21, wherein said safety means comprises a washer element mounted interiorly in said main housing against which the tip of said dart-member abuts; said washer element being made of a material that melts in response to the temperatures associated with the interior of the well-block opening of a ladle, whereby said washer melts when the bores of the well-block and slide-gate are aligned allowing the release of said dart-member.

23. A method of piercing through and breaking open a blockage in an exit-bore of a ladle for holding and transporting molten steel, which exit-bore is filled with refractory sand, which ladle has associated therewith a slide-gate having an exit-bore for closing off the exit-bore of the ladle and for allowing the pouring out of the molten steel when the two exit-bores are in alignment, said method comprising:

(a) mounting a dart-assembly having a dart-member in the exit-bore of the slide-gate; said dart-assembly comprising a main housing having a diameter less than the diameter of the exit-bore of the slide-gate, and means for centering the main housing within the exit-bore of the slide-gate;

(b) automatically firing the dart-member when the two exit-bores are in alignment;

said step (a) comprising:

(c) substantially centering the main housing of the dart-assembly via the means for centering in the exit-bore of the slide-gate to define an annular empty volume between the main housing and the inner wall surface of the exit-bore of the slide-gate; and (d) preventing said step (b) until the exit-bores of the slide-gate and ladle are in complete coaxial alignment.

24. The method according to claim 23, wherein said step (d) comprises closing off the open upper mouth of the main housing with a pivotal closure member; said step (d) comprising mounting the main housing in the exit-bore of the slide-gate such that the pivotal closure member abuts against the underside of a portion of the ladle such that the pivotal closure member is retained in its downwardly-pivoted, closing-off state to prevent the firing of the dart-member.

25. The method according to claim 24, wherein said step (b) comprises:

partially aligning the exit-bores of the slide-gate and ladle and allowing the refractory sand in the exit-bore of the ladle to flow out through the exit-bore of the slide-gate via the annular empty volume between the main housing and said inner wall surface of the exit-bore of the slide-gate; and, thereafter, ejecting the dart-member when the exit-bores are in complete coaxial alignment; said step of ejecting comprising positioning the pivotal closure member entirely under the exit-bore of the ladle where the pivotal closure member is thereby free to pivot upwardly into the interior of the exit-bore of the ladle.

26. The method according to claim 23, wherein the dart assembly comprises a main housing having a diameter less than the diameter of the exit-bore of the slide-gate, and means for centering the main housing within the exit-bore of the slide-gate, the dart-member having an enlarged dart-head portion and an elongated rod extending from therefrom and having a lower threaded end portion, a slidable member on a portion of the elongated rod, a compression spring mounted about the elongated rod and between the enlarged head-portion and the slidable member, and a restraining nut threadingly mounted to the lower threaded end portion of the elongated rod, said step (a) comprising:

inserting the main housing in the exit-bore of the slide-gate such that the restraining nut is still accessible;

removing the restraining nut from the lower threaded end portion of the elongated rod;

said step of removing causing the compression spring to push the slidable member downwardly to thereby push the means for centering outwardly into contact with the interior wall surface of the exit-bore of the slide-gate.

27. In a ladle for holding and transporting molten material, said ladle comprising a well-block having an exit-bore through which the molten material exits, said exit-bore having refractory sand therein forming an interface with the molten material contained in said ladle, which interface defines a blockage preventing the flow of molten material therepast, and a slide-gate for controlling the removal of the molten material, said slide-gate having a main frame, means for sliding the main frame relative to said well-block, said slide-gate having an exit-bore that is capable of alignment with said exit-bore of said well-block when said means for sliding align said exit-bores, wherein the improvement comprises:

piercing means mounted in said exit-bore of said slide-gate for piercingly breaking open the blockage at said interface between said refractory sand and said molten material; and delay means for preventing the firing of said piercing means until said exit-bores are in alignment.

28. The improvement according to claim 27, further comprising safety means for preventing the accidental firing of said piercing means.

* * * * *